US012448759B1

(12) United States Patent
Swatsworth

(10) Patent No.: US 12,448,759 B1
(45) Date of Patent: Oct. 21, 2025

(54) ROGER'S EZ SHOWER

(71) Applicant: Roger Carl Swatsworth, Curwensville, PA (US)

(72) Inventor: Roger Carl Swatsworth, Curwensville, PA (US)

( * ) Notice: Subject to any disclaimer, the term of this patent is extended or adjusted under 35 U.S.C. 154(b) by 0 days.

(21) Appl. No.: 19/081,185

(22) Filed: Mar. 17, 2025

Related U.S. Application Data

(60) Provisional application No. 63/634,995, filed on Apr. 17, 2024.

(51) Int. Cl.
*E03C 1/04* (2006.01)
*A47K 3/28* (2006.01)

(52) U.S. Cl.
CPC ..... *E03C 1/0408* (2013.01); *A47K 3/281* (2013.01)

(58) Field of Classification Search
CPC ..... A47K 3/281; A47K 3/004; A47K 3/03; E03C 1/0408; E03C 1/04; E03C 1/18
USPC ..... 4/553, 559, 571.1
See application file for complete search history.

(56) References Cited

U.S. PATENT DOCUMENTS

| | | | | | |
|---|---|---|---|---|---|
| 1,288,347 | A * | 12/1918 | Wilson | A47K 3/007 | 4/550 |
| 3,834,782 | A * | 9/1974 | Pampinella | A47K 3/004 | 312/249.7 |
| 5,940,905 | A * | 8/1999 | Cheng | A47K 3/122 | 4/578.1 |
| 10,952,544 | B2 * | 3/2021 | Sclare | A47D 5/00 | |
| 2004/0139543 | A1 * | 7/2004 | Courouzos | A47K 3/074 | 4/572.1 |
| 2020/0337504 | A1 * | 10/2020 | Swiney | A47K 4/00 | |

* cited by examiner

*Primary Examiner* — Christine J Skubinna
(74) *Attorney, Agent, or Firm* — Jonathan D'Silva; Benjamin Clarke; Penn State Dickinson Law IP Clinic

(57) ABSTRACT

A shower apparatus including a stationary frame configured to sit atop a bathtub. The stationary frame includes a first support that contacts the first edge of said bathtub. A second support is configured to contact a second edge opposite the first edge of said bathtub. Additionally, a connecting support extends between the first support and the second support defining an inner area configured to fit a top surface. The top surface includes a basin for retaining water, and a cutout for holding a showerhead.

8 Claims, 5 Drawing Sheets

ROGER'S EZ SHOWER

BACKGROUND

For individuals having issues with breathing, showers can pose a significant hurdle to everyday life. Conditions including chronic obstructive pulmonary disease (COPD), asthma, emphysema, and bronchitis make it increasingly difficult for individuals to bend over, maneuver, and breath due to the steam produced by a shower. Current solutions revolve around implementing an entirely new shower unit or utilizing a shower chair that only has a marginal effect. Installing a shower unit is not feasible for every individual and a shower chair does not facilitate accessibility. Therefore, there is a need for an easily installable shower accessory that promotes the maneuverability of the user.

The shower apparatus presented herein pertains to a lap-high rolling basin and surface that enhances accessibility and comfort for individuals with breathing difficulties. The apparatus includes an adjustable top surface that allows the user to easily maneuver the showering apparatus to be positioned directly above the user. When engaged the user may be able to access a top surface for supporting washing material, and a basin which eliminates the need to bend over and strain to maneuver the shower. Additionally, the apparatus includes a showerhead cutout so that users can adjust the water flow and direction without the need to reach or strain.

SUMMARY

What is presented is a showering apparatus having a stationary frame and a top surface. The stationary frame includes a first support that sits on top of an edge of bathtub and a second support that sits atop an opposite edge of the bathtub. A connecting support extends between the first support and the second support which creates an inner area that is configured to fit the top surface. The top surface has a basin for retaining ware, a cutout for holding a showerhead, and is configured to fit within the inner area.

The first support and second support may include a vertically extendable element allowing the height of the top surface to be adjusted such that it fits the user and bathtub. The top surface and connecting support may have a horizontal extendable element allowing the distance between the first support and second support to be adjusted to fit bathtubs of varying sizes.

The showering apparatus may include an adjustable frame in which two movable supports are attached to the top surface. In a closed configuration the adjustable frame including the top surface occupies the inner area defined by the first support, second support, and connecting support. In an open configuration the adjustable frame including the top surface may be moved such that the adjustable frame and top surface are in an area outside of the inner area. Transitioning between configurations may be aided by a movable element that is attached at the bottom of both movable supports and may include wheels, or slides. The showering apparatus may also include locking elements that allow the showering apparatus to be locked into an open or close configuration.

Those skilled in the art will realize that this invention is capable of embodiments that are different from those shown and that details of the apparatus and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
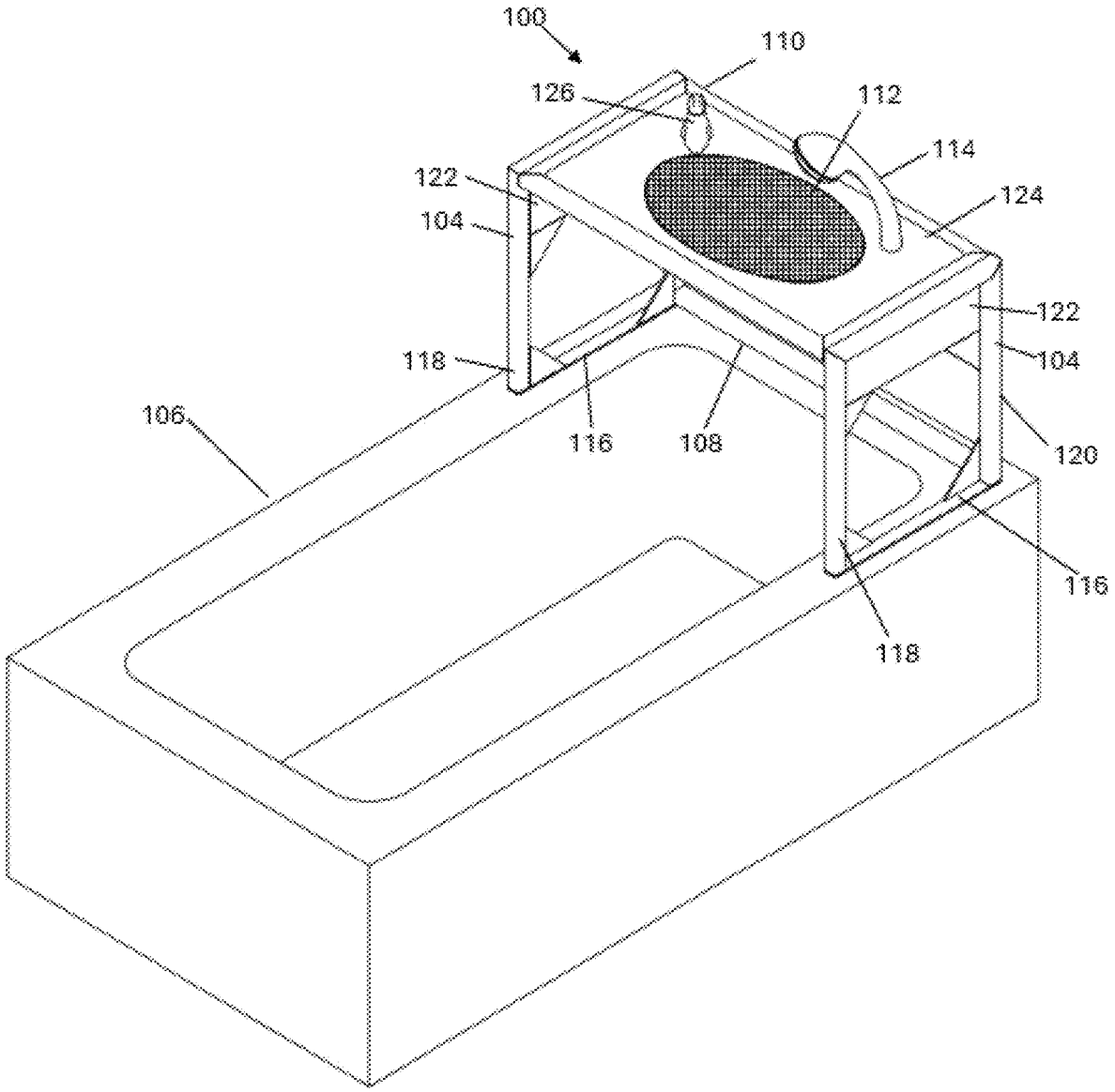
FIG. 1 is a perspective view of the showering apparatus sitting atop a bathtub.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Figure 2:
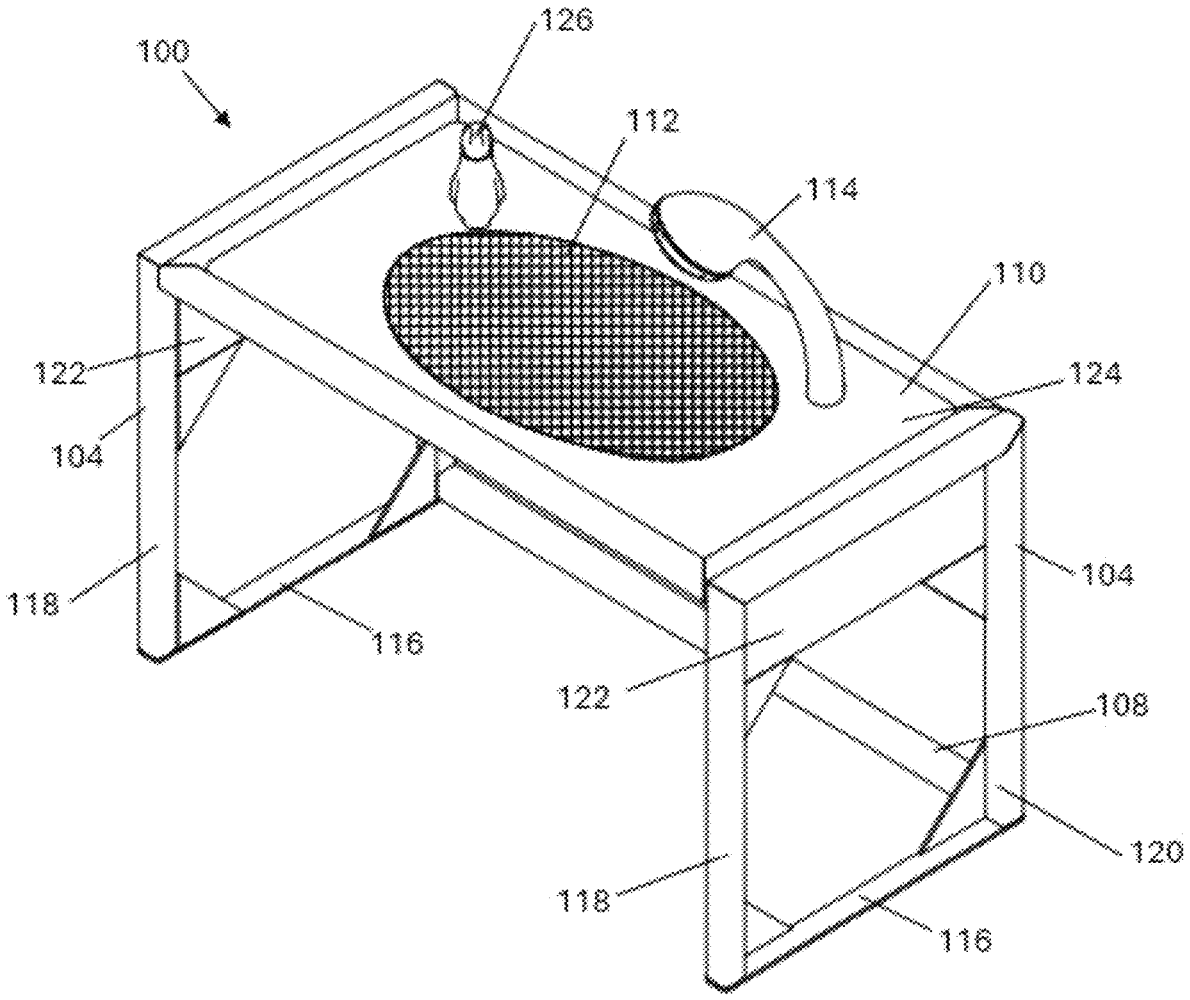
FIG. 2 is a perspective view of the showering apparatus of FIG. 1.

Described herein is a shower apparatus for providing a sink within a bathtub as seen in FIG. 1 and FIG. 2. Shower apparatus 100 includes two supports 104 configured to sit on top of the edge of bathtub 106 at opposite ends. Additionally, shower apparatus 100 includes a connecting support 108 that connects two supports 104, and a top surface 110 that is configured to fit between the two supports 104. Top surface 110 includes a basin 112 for retaining water, and a cutout (not shown) for holding a showerhead 114.

Two supports 104 both include a contact surface 116, a front vertical support 118, a rear vertical support 120, and a horizontal support 122 that forms a rectangular shape. Contact surface 116 is designed to contact the edge of bathtub 106. Front vertical support 118 and rear vertical support 120 extend vertically from contact surface 116 defining a height. Both front vertical support 118 and rear vertical support 120 may include extendable elements that allow a user to adjust the height of shower assembly 100. The extendable element may include springs and pins for locking the front vertical support 118 or rear vertical support 120. Horizontal support 122 extends from front vertical support 118 to rear vertical support 120. Connecting support 108 extends between two supports 104 and connects to each rear vertical support 120. Two supports 104 and connecting support 108 define an inner area in which top surface 110 is configured to fit.

Top surface 110 includes a basin 112, and a cutout for holding a showerhead 114. Top surface 110 may include a flat area 124 allowing items to be placed on top of top surface 110. Flat area 124 may include facet 126 that may be connected to a water supplying source. Facet 126 may include controls for flow and temperature that manipulates the water received by facet 126. Additionally, top surface 110 may include showerhead 114 that is disposed in a cutout. The cutout for showerhead 114 is configured to hold showerhead 114 while it dispenses water near basin 112 which provides a steady stream of water. Showerhead 114 may alternatively be attached to top surface 110 and connected to a water source. Additionally, showerhead 114 may be detached from the cutout and utilized as a typical showerhead. Basin 112 is configured to retain water from a water source provided from facet 126 or showerhead 114. Basin 112 may include a drain having an open and closed configuration. In an open configuration water that enters basin 112 can flow through the drain such that water is emptied from basin 112. In a closed configuration the drain is closed, not allowing water to exit basin 112. Therefore, water collects in basin 112.

In some embodiments, the distance between two supports 104 may be altered by utilizing extendable elements in connecting support 108, and top surface 110. Including an extendable element to adjust the width of showering apparatus 100 allows the apparatus to be adapted to any bathtub regardless of variations in bathtub sizes.

FIGS. 1 and 2 illustrate one embodiment of showering apparatus 100 in a stationary configuration. In a stationary configuration the top surface 110 is attached to two supports 104 by horizontal supports 122. Alternatively, the shower apparatus may have an adjustable feature.

A user may utilize shower apparatus 100 in combination with a shower chair (not shown). A shower chair may be placed in a bathtub 106 giving support to the user. The height of showering apparatus 100 may be manipulated utilizing vertical extendable elements such that the height is proportionate to the user. Having the height at an appropriate height limits the strain on the user reaching items on top surface 110. Additionally, the width defined as the distance between supports 104 may be manipulated using horizontal extendable elements such as supports 104 align with the edges of bathtub 106.

In the stationary configuration the user may position the chair underneath showering apparatus 100, allowing a user to reach items that are placed on flat surface 124, and utilize features such as facet 126, showerhead 114, and basin 112. Having all these features within reach of the user eliminates the need for user to bend over and maneuver which alleviates the pressure on the user's breathing.

Figure 3:
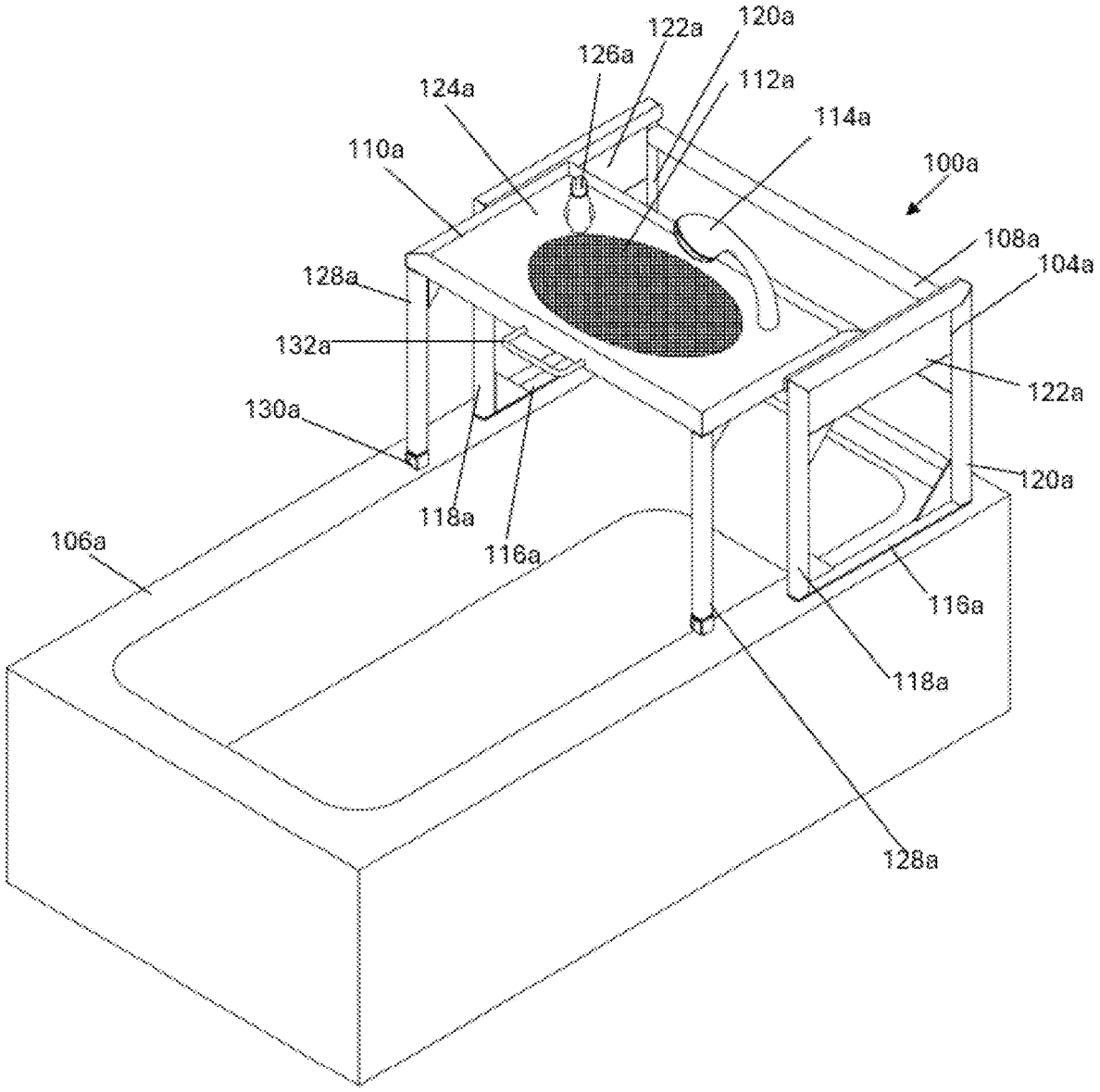
FIG. 3 is a perspective view of another embodiment of the showering apparatus being adjustable and positioned in an open configuration sitting atop a bathtub.
Figure 4:
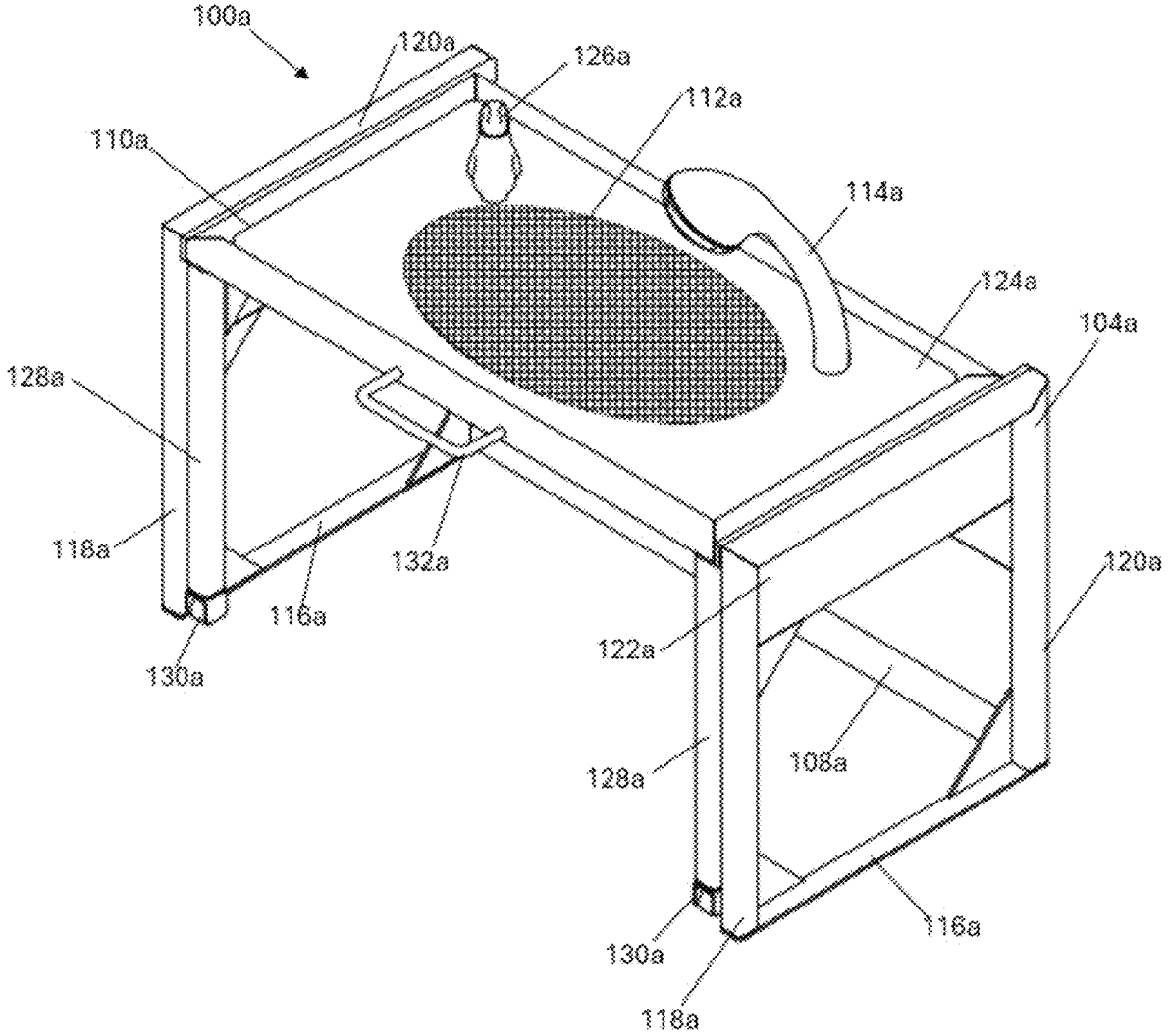
FIG. 4 is a perspective view of the adjustable showering apparatus of FIG. 3 in a closed configuration.
Figure 5:
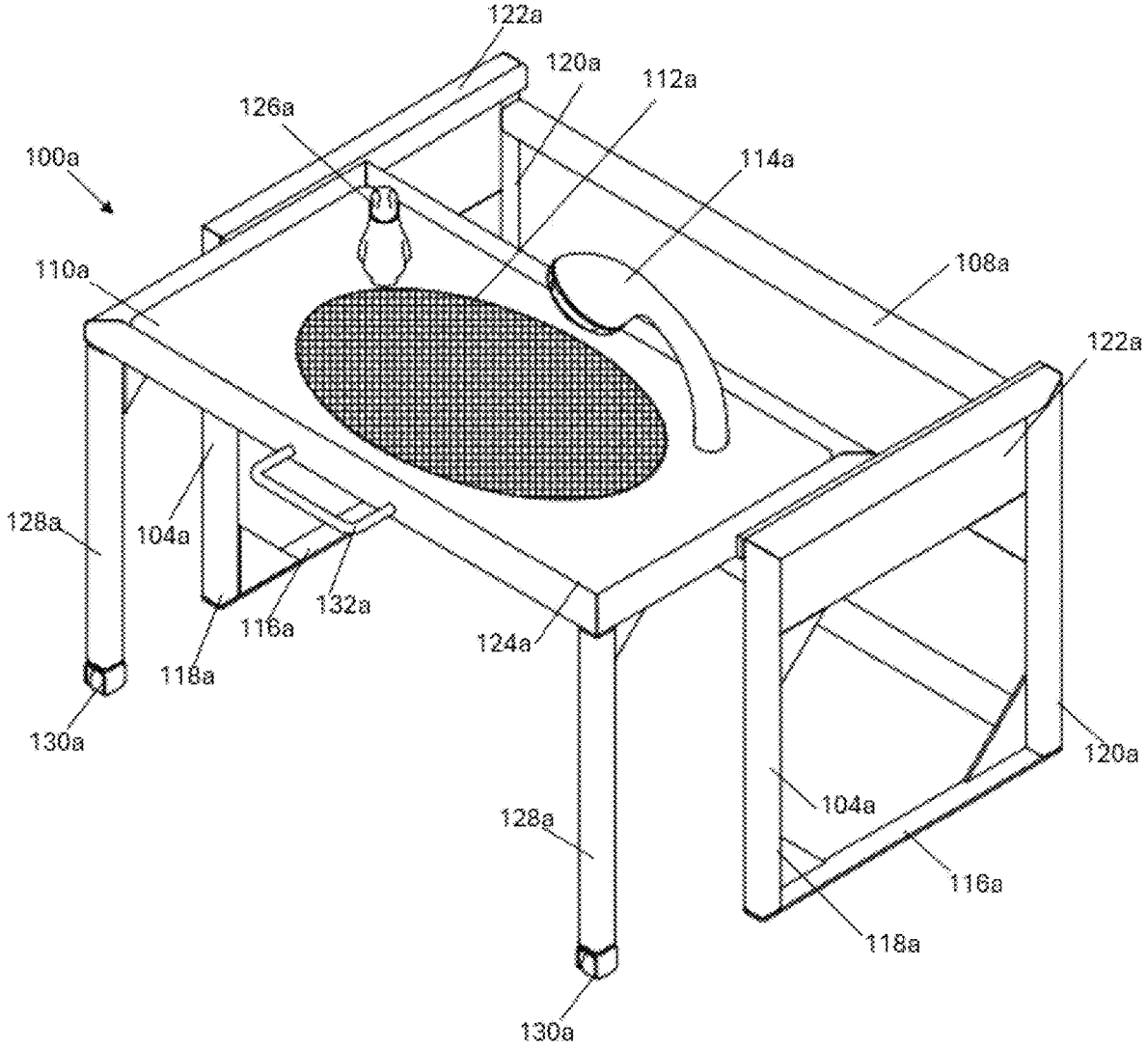
FIG. 5 is a perspective view of the adjustable showering apparatus of FIG. 3 in an open configuration.

FIGS. 3, 4, and 5 illustrate another embodiment of showering apparatus 100*a* having an movable top surface. FIG. 4 shows adjustable showering apparatus 100*a* in a closed configuration. In the closed configuration top surface 110*a* occupies the inner area defined by two supports 104 and connecting support 108*a*. Top surface 110*a* sits atop horizontal support 122*a* but is not connected mechanically. Sitting inside the inner area serves as a guide for moving the top surface 106*a* from an open configuration to a closed configuration. Top surface 110*a* includes a movable support 128*a* that offers support when top surface 110*a* is moved from a closed configuration to an open configuration. Movable supports 128*a* may include a movable element 130*a* such as a wheel or slide at the bottom of the movable supports 128*a* that allows the facilitation of the transition from a closed to open configuration. Adjustable showering apparatus 100*a* may additionally include a handle 132*a* attached to top surface 110*a* allowing adjustable showering apparatus 100*a* to be transitioned from a closed configuration to an open configuration.

FIG. 5 shows adjustable showering apparatus 100*a* in an open configuration. In the open configuration top surface 110*a* occupies an area outside of the inner area defined by two supports 104*a* and connecting support 108*a*. By transitioning from a closed configuration to a open configuration a user can move basin 112*a* attached to top surface 110*a* closer to the user such that it can be more easily engaged. Movable support 128*a*, movable element 130*a* and handle 132*a* may be used to transition between the closed configuration and open configuration. Adjustable showering apparatus 100*a* may include a locking system that utilizes a locking element to fix the position of top surface 110*a* relative to the inner area. The locking system may lock top surface 110*a* in either a closed or open configuration. Additionally, movable supports 128*a*, and two supports 104*a* may include a vertical extendable element allowing the height of top surface 110*a* to be adjusted to the user's height.

Adjustable showering apparatus 100*a* may be utilized such that the position of top surface 110*a* can be manipulated to engage the user at various positions within bathtub 106*a*. For example, a showering chair may be placed in a position a distance from showering apparatus 100*a* which eliminates the likelihood that a user would become entangled and fall over due to showering apparatus' 100*a* position. When a user wants to utilize showering apparatus 100*a* the user can pull top surface 110*a* from the closed configuration towards the user such that it occupies an area above the user. The action of pulling top surface 110*a* may be aided by a series of wheels, slides, and handles. Once the top surface 110*a* is pulled into an open configuration the user can access the features of showering apparatus 100*a* like the stationary configuration. After a user is finished utilizing shower apparatus 100*a* top surface 110*a* may me pushed in moving showering apparatus 100*a* from an open configuration to a closed configuration. Once in the closed configuration shower apparatus 100*a* is no longer obstructing the movement of the user which minimizes the potential for injury. At any point in transitioning from open configuration to the closed configuration a locking system including locking elements may be utilized to lock top surface 110*a* in place. The locking system may additionally be utilized in the open configuration, the closed configuration, or when transitioning from the closed to open configuration.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A showering apparatus comprising:

a stationary frame configured to sit atop a bathtub including a first support that contacts a first edge of said bathtub, a second support configured to contact a second edge opposite said first edge of said bathtub, and a connecting support that extends between said first support and said second support defining an inner area configured to fit a top surface;

said top surface includes a basin for retaining water, a cutout for holding a showerhead, and is configured to be positioned within said inner area;

an adjustable frame including a first movable support, a second movable support, and said top surface that extends from said first movable support to said second movable support;

wherein a closed configuration said adjustable frame occupies said inner area; and wherein an open configuration said adjustable frame is moved such that a portion of said adjustable frame is outside of said inner area between said first support and said second support.

2. The showering apparatus of claim 1 wherein, said first support and second support includes a vertical extendable element allowing the height of the top surface to be adjusted.

3. The showering apparatus of claim 1 wherein, said connecting support and said top surface includes a horizontal extendable element allowing a distance between said first support and said second support to be adjusted.

4. The showering apparatus of claim 1 wherein said basin includes a drain.

5. The showering apparatus of claim 1 wherein, said extendable element includes a locking element that locks said showering apparatus in either said closed configuration or said open configuration.

6. The showering apparatus of claim 1 further comprising a movable element selected from a group consisting of wheels, and slides.

7. The showering apparatus of claim 1 wherein, said first support, second support, said first movable support, and said second movable support includes a vertical extendable element allowing the height of the top surface to be adjusted.

8. A showering apparatus comprising:

a first support including a first contact surface configured to contact a first edge of a bathtub, a first front vertical support extending vertically from said first contact surface, a first rear vertical support extending vertically from said first contact surface, a first horizontal support connecting said first front vertical support to said first rear vertical support, and wherein said first contact surface, said first front vertical support, said first rear vertical support, and said first horizontal support form a rectangle shape;

a second support including a second contact surface configured to contact a second edge opposite of said first edge of said bathtub, a second front vertical support extending vertically from said second contact surface, a second rear vertical support extending vertically from said second contact surface, a second horizontal support connecting said second front vertical support to said second rear vertical support, and wherein said second contact surface, said second front vertical support, said second rear vertical support, and said second horizontal support form a rectangle shape;

a connecting support connecting said first rear vertical support to said second rear vertical support;

a top surface situated between said first horizontal support and said second horizontal support including a flat surface, a basin, a cutout configured to receive a showerhead, a first adjustable support running parallel and adjacent to said first front vertical support, and a second adjustable support running parallel and adjacent to said second front vertical support;

wherein a closed configuration said top surface occupies an area between said first support and said second support; and wherein an open configuration said top surface is moved such that at least a portion of said first adjustable support, said second adjustable support, and said top surface are outside of a area between said first support and said second support.

* * * * *